US006611235B2

(12) United States Patent
Barna et al.

(10) Patent No.: US 6,611,235 B2
(45) Date of Patent: Aug. 26, 2003

(54) ANTENNA COUPLING DEVICE

(75) Inventors: Zsolt Barna, Budapest (HU); Peter Lindberg, Uppsala (SE)

(73) Assignee: Smarteq Wireless AB, Enebyberg (SE)

( * ) Notice: Subject to any disclaimer, the term of this patent is extended or adjusted under 35 U.S.C. 154(b) by 0 days.

(21) Appl. No.: 10/086,416

(22) Filed: Mar. 4, 2002

(65) Prior Publication Data

US 2002/0154066 A1 Oct. 24, 2002

(30) Foreign Application Priority Data

Mar. 7, 2001 (SE) ..... 0100775

(51) Int. Cl.[7] ..... H01Q 1/24; H01Q 1/50
(52) U.S. Cl. ..... 343/702; 343/906
(58) Field of Search ..... 343/702, 905, 343/906, 846, 848, 711, 713, 841

(56) References Cited

U.S. PATENT DOCUMENTS 5,777,585 A * 7/1998 Tsuda et al. ..... 343/702
5,852,421 A * 12/1998 Maldonado ..... 343/702
5,966,098 A * 10/1999 Qi et al. ..... 343/702

* cited by examiner

*Primary Examiner*—Hoang Nguyen
(74) *Attorney, Agent, or Firm*—Jacobson Holman PLLC

(57) ABSTRACT

The present invention relates to an antenna coupling device (14) for coupling radio frequency signal from a communication device (10) having an internal first antenna, the communication device (10) operable in n frequency bands, where n>1 and n is an integer. The antenna coupling device (14) comprises a port (16) connected/connectable to a transmission line (18). A conducting surface of said antenna coupling device (14) has a geometric shape in the form of a tree structure (20) connected to said port (16). The tree structure (20) comprises a number, m, of branches, where $m \geqq n$, wherein said tree structure (20) comprises at least one branch $b_{ix}$ for each frequency band I of said communication device (10), wherein I is an integer and $1 \leqq I \leqq n$, and x is an integer and $1 \leqq x \leqq k$ (i), and the total number, m, of branches satisfy the following expression $$\sum_{i=1}^{n} k(i) = m$$

wherein k (i) is a function of I, which only can obtain an integer value and is the total number of branches for frequency band.

15 Claims, 22 Drawing Sheets

ANTENNA COUPLING DEVICE

TECHNICAL FIELD OF THE INVENTION

The present invention relates to an antenna coupling device for coupling radio frequency signals from a communication device having an internal first antenna.

DESCRIPTION OF RELATED ART

Some older types of mobile telephones have been equipped with a coaxial connector to which a conductor to a second antenna can be attached, simultaneously disconnecting the first antenna of the telephone. However, the trend towards smaller, lighter and cheaper mobile telephones has led to new models which do not offer this facility. If connection to a second antenna is desired, an electromagnetic coupler must be used, though this solution results in inevitable losses. For the first, the couplers work in the near field of the first antenna impairing the drift of the telephone which may cause losses. For the second, part of the electromagnetic energy cannot be picked up by the coupler, this results in radiation inside the car.

Different models of couplers are needed to fit different types of telephones depending on the first antenna. A complication is that operation at two frequency bands is required.

Most of the telephones from the last decade and some new ones are equipped with short top loaded monopole antennas or short helix antennas protruding from the top of the mobile telephone device. Couplers to such antennas have been described in several patents, e.g., in SE 500 983, SE 503 930, U.S. Pat. No. 5,619,213, JP 82 79 712, SE 504 343, U.S. Pat. No. 5,668,561 and WO 98/25323. A common feature of these solutions is that they use coils. The electromagnetic coupling relies mainly upon the magnetic component of the near field. A different solution involving a meander pattern has been presented in SE 506 726 and SE 507 100. The electromagnetic coupling depends in this case as well upon the electric as the magnetic component of the field.

Recently many mobile telephones have been equipped with internal antennas. A common type is the slot antenna and especially popular is the planar inverted F (PIFA) antenna. The near field patterns of such antennas vary to a greater extent than those of monopoles and helices. Consequently, couplers have to be individually designed for each type of mobile telephone with internal antenna. A coupler well suited for some n-band (n>1) internal PIFA antennas, making use mainly of the electric component of the near field, has been presented in SE 0002575-9. One disadvantage with this coupler is that the n frequency bands are not independent of each other, due to the fat that the coupler only has one branch.

The document EP 0 999 607 discloses an antenna coupler comprising a planar conductive antenna element, which is essentially similar to the planar conductive antenna element in the mobile telephone. Additionally the antenna coupler comprises a piece of dielectric material for holding the conductive antenna element, and a first ground plane which is conductive, essentially continuous and essentially parallel to the conductive antenna element. This antenna coupler is intended to be tilted in relation to the antenna element in the mobile telephone with an angle, $\alpha$. One disadvantage with this solution is that it implies a great distance between the coupler and the antenna element. This fact reduces the coupling factor. another disadvantage is that this solution takes up too much space.

SUMMARY OF THE INVENTION

It is an object of the present invention to solve the above mentioned problems.

According to the present invention there is provided an antenna coupling device for coupling radio frequency signals from a communication device having an internal first antenna. The communication device is operable in n frequency bands, where n>1 and n is an integer. The antenna coupling device comprises a port connected/connectable to a transmission line. A conductive surface of said antenna coupling device has a geometric shape in the form of a tree structure connected to said port. The tree structure comprises a number, m, of branches, where $m \geqq n$. The tree structure comprises at least one branch $b_{ix}$ for each frequency band i of said communication device, wherein i is an integer and $1 \leqq i \leqq n$, and x is an integer and $1 \leqq x \leqq k(i)$, and the total number, m, of branches satisfy the following expression $$\sum_{i=1}^{n} k(i) = m$$

wherein k(i) is a function of i, which only can obtain an integer value and is the total number of branches for a frequency band i.

A main advantage with this antenna coupling device is that it is capable of operating in n independent frequency bands. This facilitates the work when designing an antenna coupling device.

A further advantage in this context is achieved if at least one branch $b_{ix}$ for each frequency band i fulfils the condition; a length of said branch $b_{ix}$, as measured form said port to a free end of said branch $b_{ix}$ is not less than about ⅛ of $\lambda_i$, where $\lambda_i$ is the wavelength in the medium at the frequency band i.

Furthermore, it is and advantage in this context if said at least one branch $b_{ix}$ for said frequency band i of said communication device is/are placed, when said antenna coupling device is in operation, above a domain i of said internal first antenna, wherein a current causing electromagnetic fields in said at least one branch $b_{ix}$ is intended to pick up a considerable part of an electromagnetic wave in said frequency band i.

A further advantage in this context is achieved if said domains are at least in part disjoint.

Furthermore, it is an advantage in this context if each branch $b_{ix}$ has a constant width.

A further advantage in this context is achieved if the widths of at least two branches $b_{ix}$ are equal.

Furthermore, it is an advantage in this context if at least one of said branches $b_{ix}$ has a variable width along said branch $b_{ix}$.

A further advantage in this context is achieved if at least one of said branches $b_{ix}$ has a part in the form of a meander line.

Furthermore, it is an advantage in this context if different branches $b_{ix}$ can intersect each other.

A further advantage in this context is achieved if further branches can be used to improve matching of impedance to a characteristic impedance of said transmission line.

Furthermore, according to one embodiment it is an advantage in this context if said antenna coupling device has an open ground plane.

A further advantage in this context according to another embodiment is achieved if said antenna coupling device has a closed ground plane.

Furthermore, according to one embodiment it is an advantage in this context if said tree structure of said antenna coupling device is placed on a printed circuit board.

A further advantage in this context according to another embodiment is achieved if said tree structure of said antenna coupling device is in the form of plating.

Furthermore, according to one embodiment it is an advantage in this context if said tree structure of said antenna coupling device is in the form of conducting ink.

It should be emphasised that the term "comprises/comprising" when used in this specification is taken to specify the presence of stated features, steps or components but does not preclude the presence of one or more other features, integers, steps, components or groups thereof.

Embodiments of the invention will now be described with a reference to the accompanying drawings, in which:

DETAILED DESCRIPTION OF EMBODIMENTS

Figure 1:
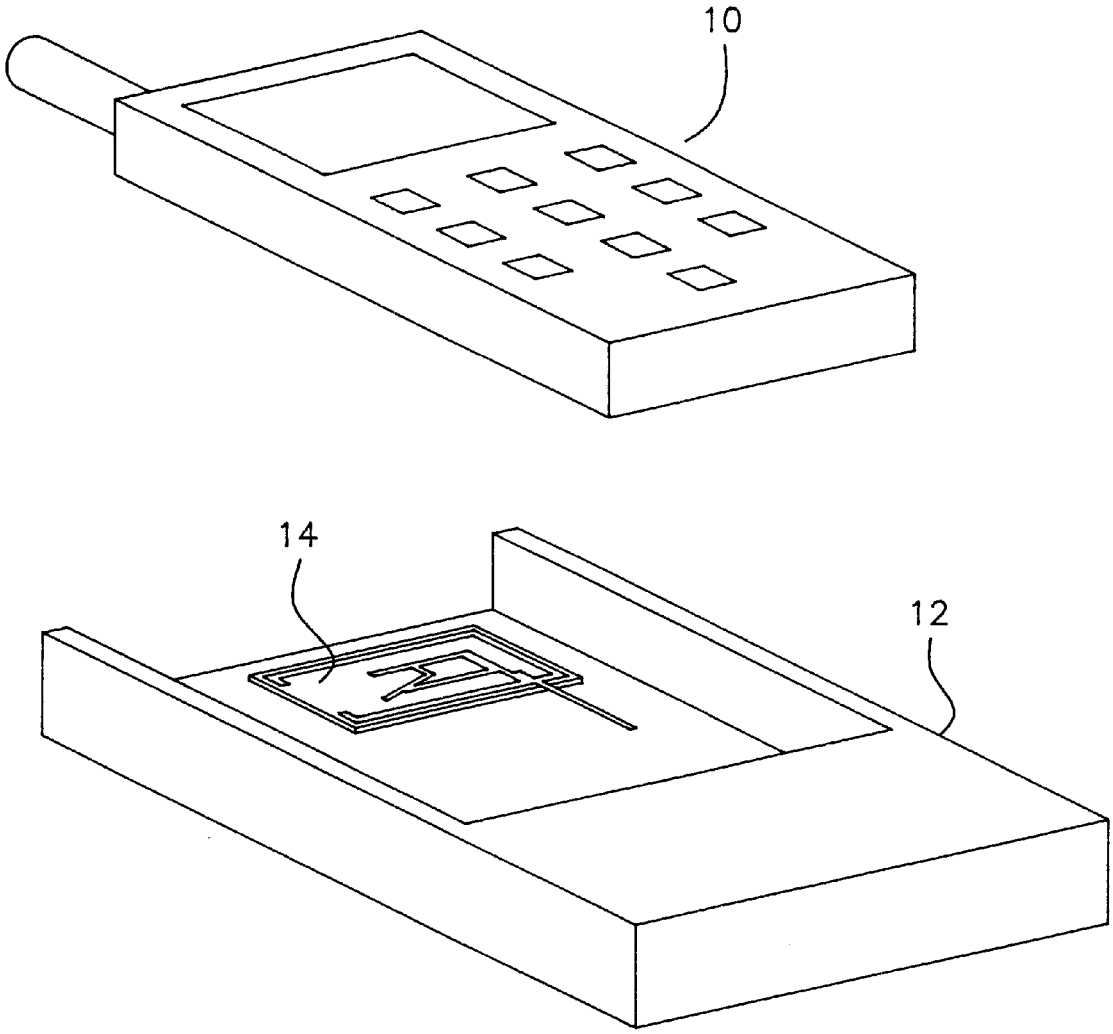
FIG. 1 is a schematic drawing of mobile telephone, an adapter and an antenna coupling device according to the present invention.

In FIG. 1 there is disclosed a schematic drawing of a communication device 10, in the form a mobile telephone 10. In FIG. 1 there is also disclosed an adapter 12, e.g. mounted in a vehicle. The adapter 12 is equipped with an antenna coupling device 14 according to the present invention.

The invention is in no way limited to applications concerning mobile telephones, but other devices that come into question are pagers, cordless telephones, radio-operated positioning devices, Personal Digital Assistant devices with radio-operated functions, portable data terminals for wireless local area networks, radio-controlled toys and models and their controller units and so on.

Definitions

The following definitions refer to the first antenna:

Band i is the frequency band No. i (i=1, 2, . . . ) of operation. (E.g., Band 1 corresponding to GSM 900 MHz, Band 2 corresponding to GSM 1800 MHz).

Frequency i is the centre or nominal frequency of band i.

Domain i is a singly connected area of the base plane where the greatest part of the radiating currents flow sending carrier wave in Band i. In order to obtain a uniform definition of this term the following, rather sophisticated method is used:

Determine the surface current densities of the first antenna in the absence of the coupler at centre (or nominal) frequency of band i. Obtain the average integrating the absolute values of the current densities over the domain and dividing by the area of the domain.

Leave those current densities out of consideration which are either greater then 3 times the mean (e.g. peak values at corners) or smaller than ⅕th of the mean (areas of weak currents).

The area where the current densities are considered, i.e., fall within the above given limits, will be considered as Domain 1.

The domain may be simply connected, i.e., internal areas where current densities are low do not exist inside the domain. However, if this is not the case, these internal areas with low current densities should be included in the domain in order to make it simply connected.

A domain is convex if it satisfies the following conditions:

Choose two arbitrary points on the contour of the domain and draw a straight line between them. If every internal points on this line lies inside the domain for any choice of the arbitrary end points then the domain is convex.

The breadth of a convex domain i, designated by $B_i$, is the smallest of the distances between pairs of parallel lines which are tangents to the contour line of the domain so that the domain lies between the lines.

In order to determine the breadth of a non convex domain use the following procedure:

Divide the domain in convex regions by the smallest possible number of straight lines. Find the breadth of each region by the method or parallel lines. Let the breadth of the smallest region be the breadth of the domain.

The centroid of the current density in Domain i is obtained from the vector formula $$r_{ci} = \frac{\int r|j|dA_i}{\int |j|dA_i}$$

where r is the radius vector from an arbitrary origin to the area element dA, $r_{ci}$ is the radius vector to the centroid of Domain i, j is the peak value of the surface current density at $dA_i$ and integration takes place over the area $A_i$ of Domain i.

The dominant direction of currents over Domain i is defined as the direction of the unit vector $e_i$ given by equation $$e_i = \frac{\int j dA_i}{|\int i dA_i|}$$

The angle between the dominant directions of currents in Domain i and k is $\alpha_{ik}$, given by the equation The distance $d_{ik}$ between the centroids of domains i and k is given by the vector equation $$\alpha_{ik} = 180/\pi \cdot \text{arc}\cos(|e_i \cdot e_k|);\ 0^\circ < \alpha_{ik} < 90^\circ$$

$$d_{ik} = |r_{ci} - r_{ck}|$$

Domains i and k are Disjoint domains if they satisfy at least one of the following conditions the areas of the domains $A_i$ and $A_k$ do not intersect the distance $d_{ik}$ is greater than half of the smaller one of the bredths $B_i$ and $B_k$ $\alpha_{ik}>30°$ The following definitions refer to the coupler Pattern is a conducting surface of the coupler which participates in the major part of electromagnetic wave transfer.

Ground plane is the electromagnetic counterweight to the pattern in the sense as it generally is used in technical literature. The ground plane can e.g. be placed on both sides of the printed circuit board.

Port is that region of the coupler to which a transmission line, such as coaxial cable, stripline or microstrip, is attached including some part of the pattern and some part of the ground plane, e.g., soldering pads, if any.

Tree is a pattern as defined above, the stem of which starts at said port and its branches are disposed so, that at least one branch belongs to each domain being in electromagnetic interaction with this domain.

Figure 2:
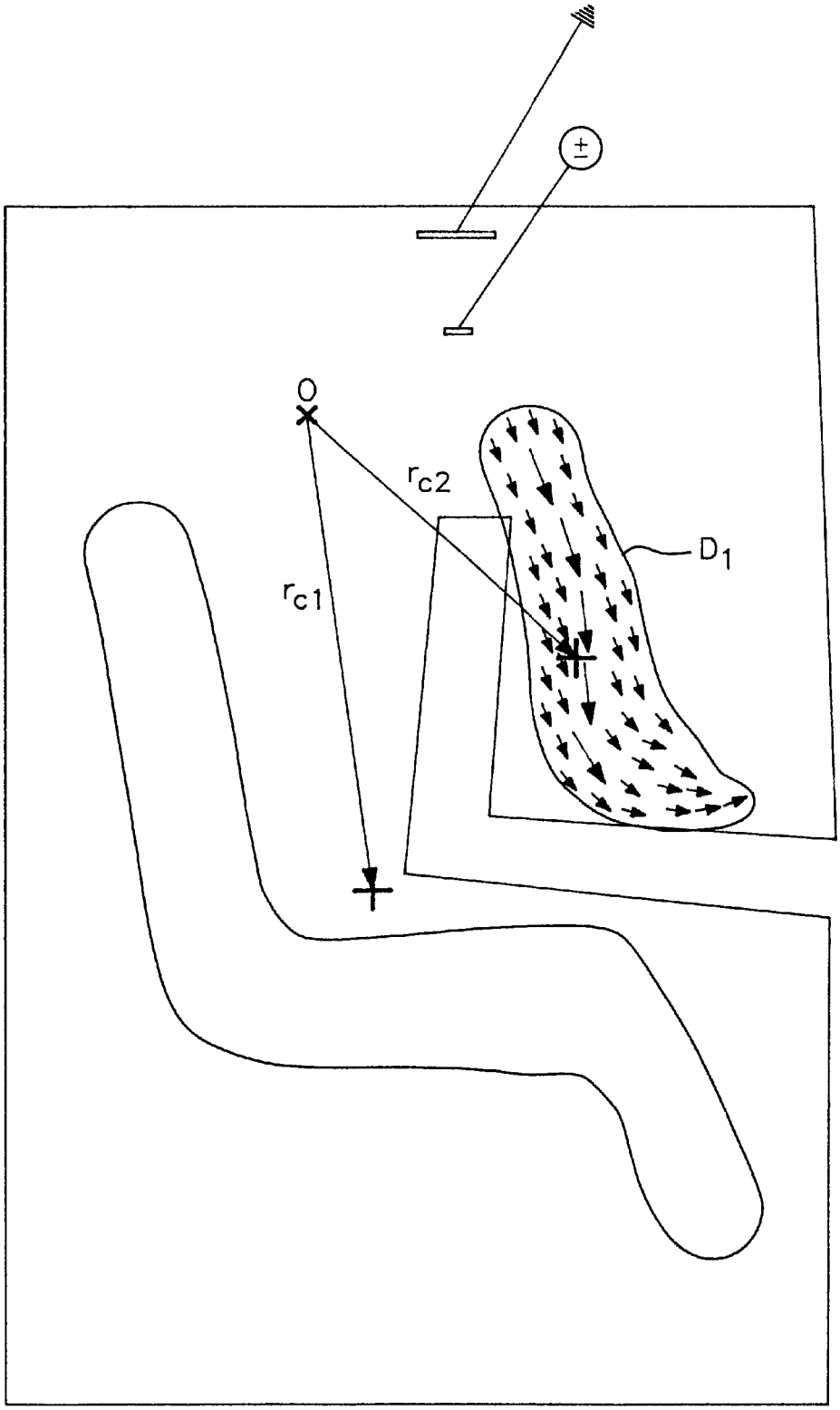
FIGS. 2 and 3 shows the current density distribution for a first embodiment of an internal first antenna.
Figure 3:
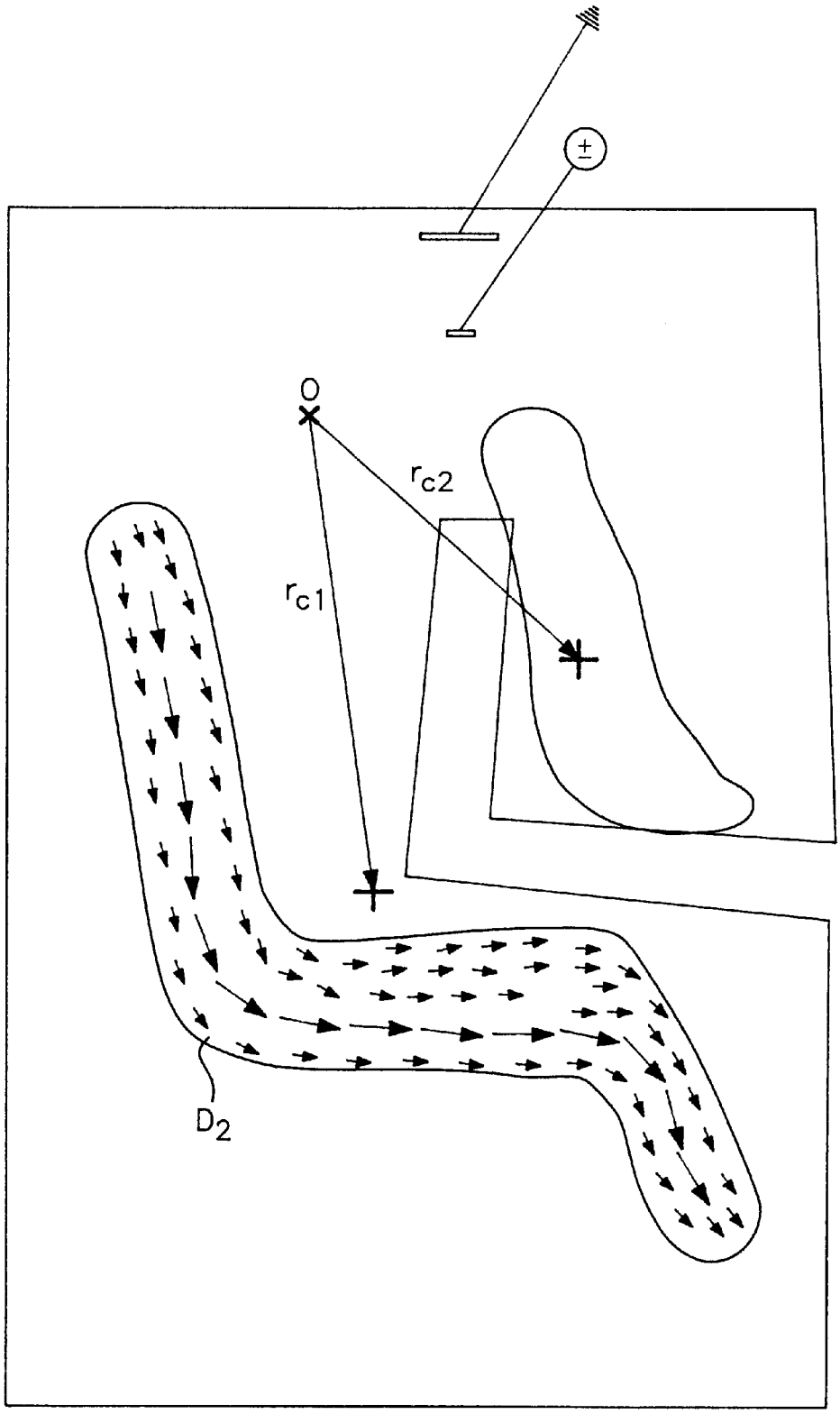

In FIGS. 2 and 3 there is disclosed the current density distribution for a first embodiment of an internal first antenna, a so called dual band antenna, i.e. an antenna capable to operate at two different frequency bands 1 and 2. In FIG. 2 there is disclosed the current density distribution, illustrated with arrows, within the first domain, $D_1$, for the frequency band 1. In FIG. 3 there is disclosed the current density distribution within the second domain, $D_2$, for the second frequency band 2.

Figure 4:
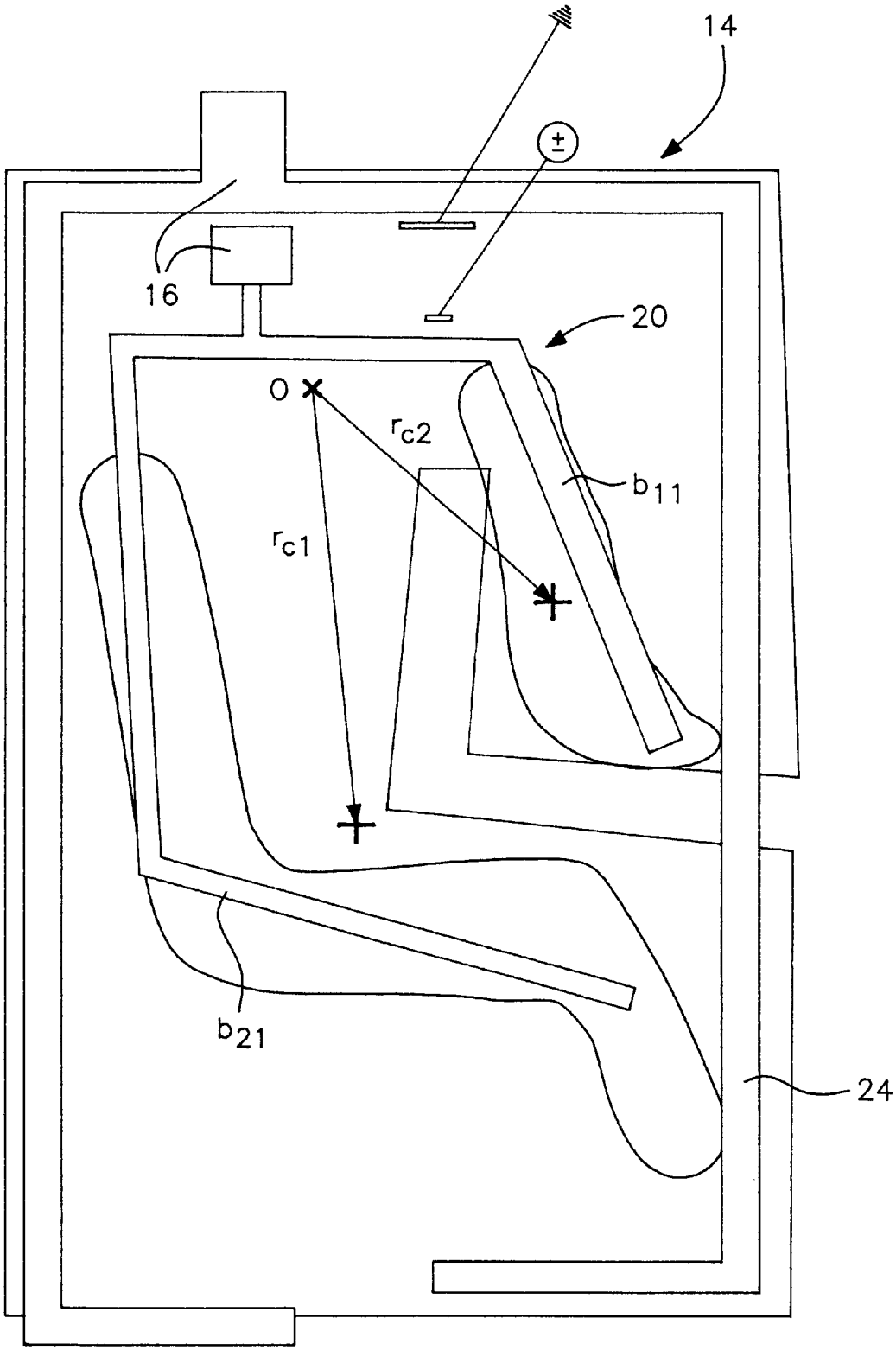
FIGS. 4 and 5 shows a first embodiment of an antenna coupling device according to the present invention, intended to be used with the first antenna according to FIGS. 2 and 3.
Figure 5:
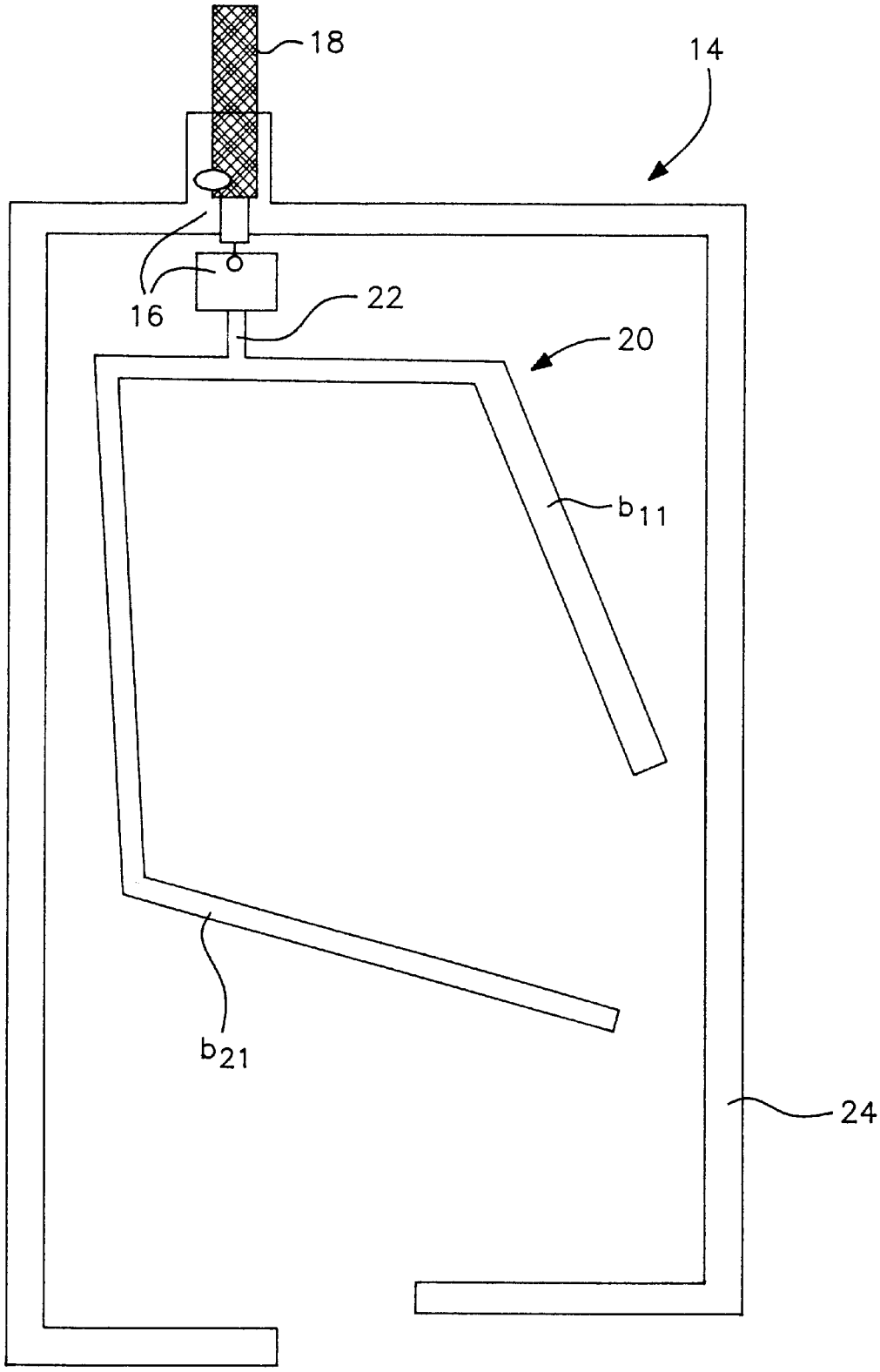

In FIGS. 4 and 5 there is disclosed a first embodiment of an antenna coupling device 14 according to the present invention, intended to be used with the first antenna according to FIGS. 2 and 3. The antenna coupling device 14 comprises a port 16 connected to a transmission line 18, here disclosed in the form of a coaxial cable 18. It is to be noted that the coaxial cable 18 is connected to the port 16 at two different points, i.e. the shield of the cable 18 is connected at one point and the centre conductor of the cable 18 is connected at another point. The conduction surface of the antenna coupling device 14 has a geometric shape in the form of a tree structure 20 connected to said port 16. The tree structure 20 comprises a stem 22 which starts at said port 16 and two branches $b_{11}$ and $b_{21}$. In this case there is only one branch for each frequency band. The branch $b_{11}$ is placed mainly above the domain $D_1$ of the first antenna and is intended to pick up a considerable part of the electromagnetic wave in the frequency band 1. The branch $b_{21}$ is mainly placed above the domain $D_2$ of the first antenna and is intended to pick up a considerable part of the electromagnetic wave in the frequency band 2. In FIGS. 4 and 5 there is also disclosed an open ground plane 24. The coaxial cable 18 can also be equipped with a wave trap.

Figure 6:
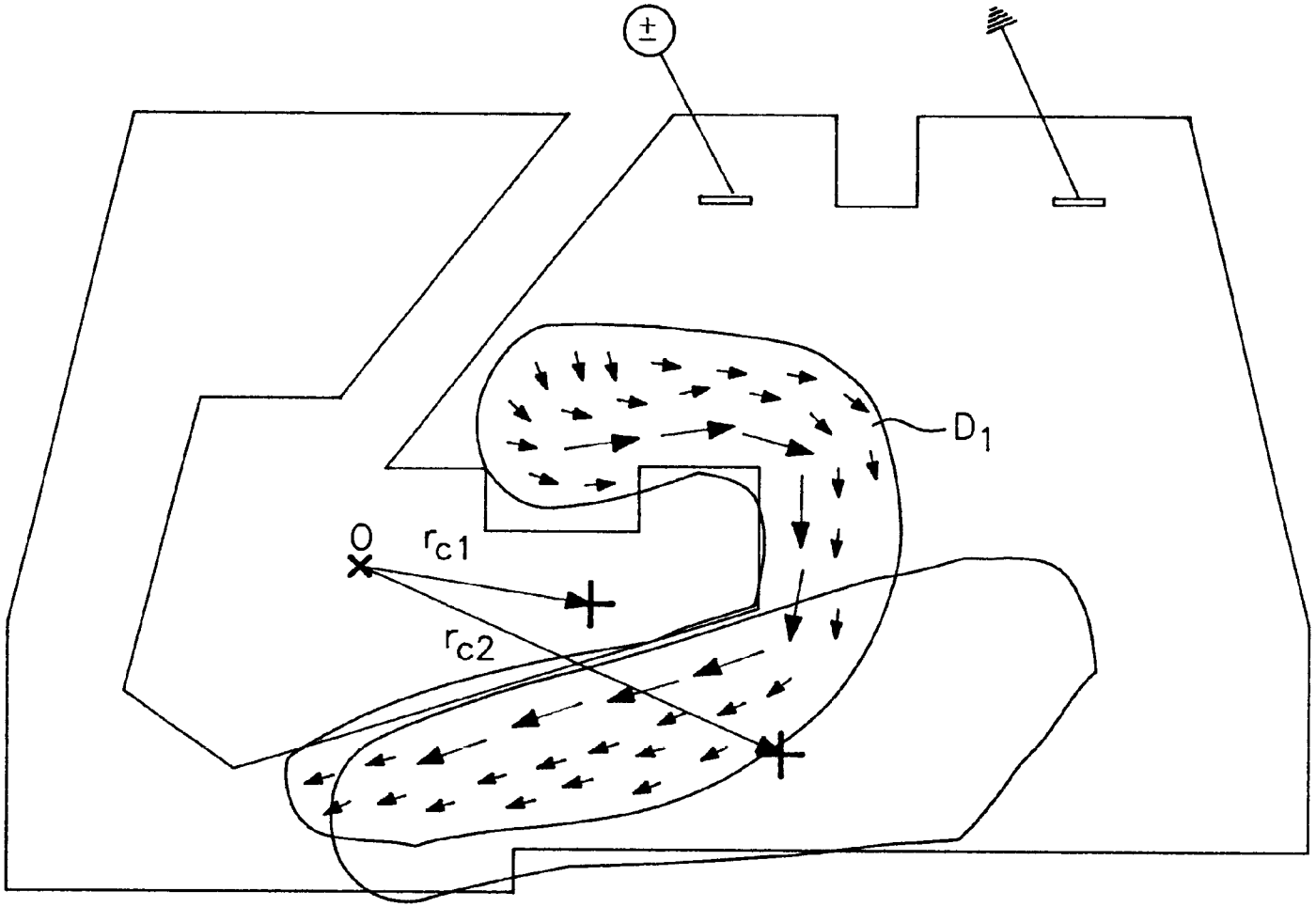
FIGS. 6 and 7 shows the current density distribution for a second embodiment of an internal first antenna.
Figure 7:
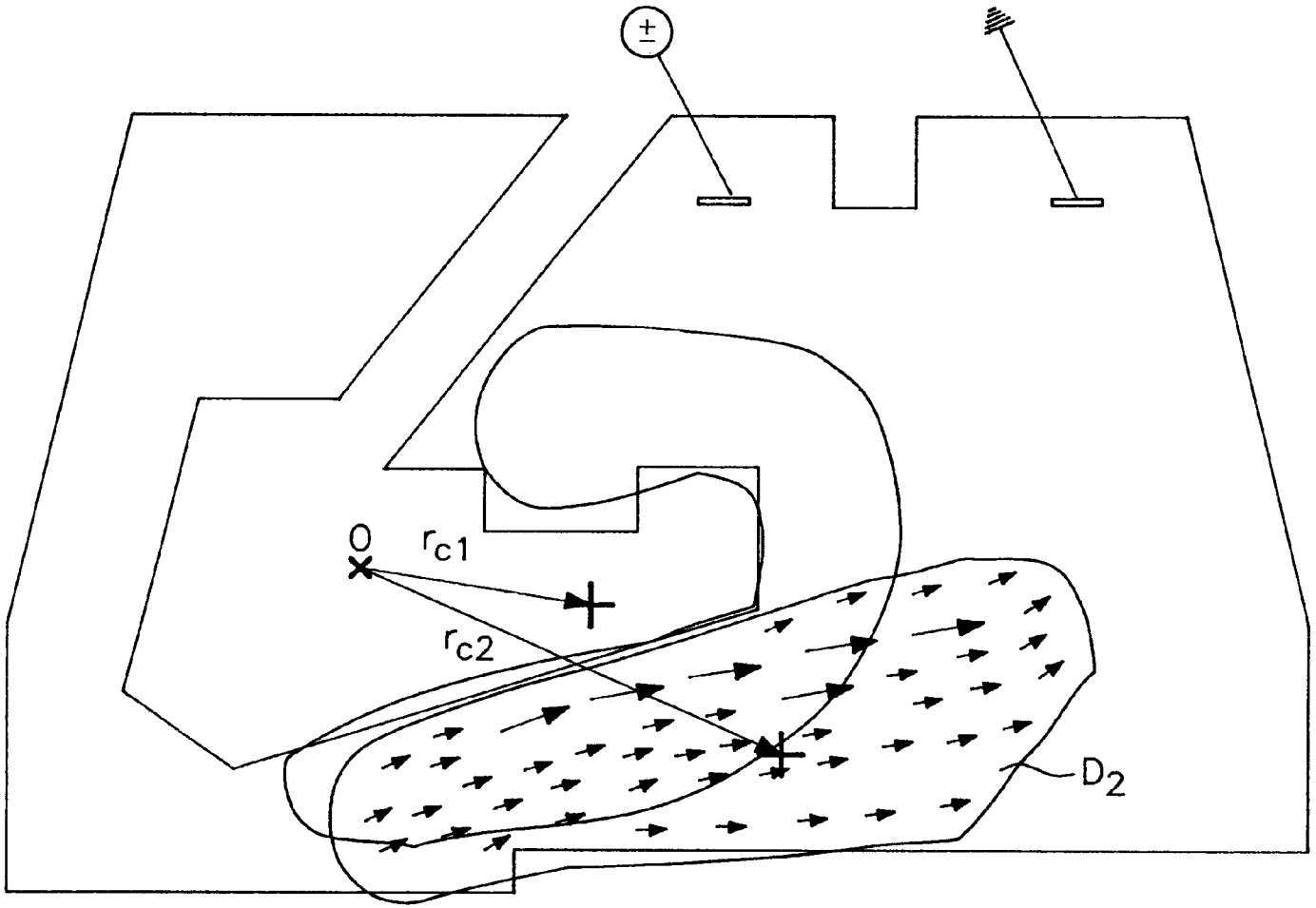

In FIGS. 6 and 7 there is disclosed the current density distribution for a second embodiment of an internal first antenna, a so called dual band antenna, i.e. an antenna capable to operate in two different frequency bands 1 and 2. In FIG. 6 there is disclosed the current density distribution within the first domain, $D_1$, for the frequency band 1. In FIG. 7 there is disclosed the current density distribution within the second domain, $D_2$, for the second frequency band 2.

Figure 8:
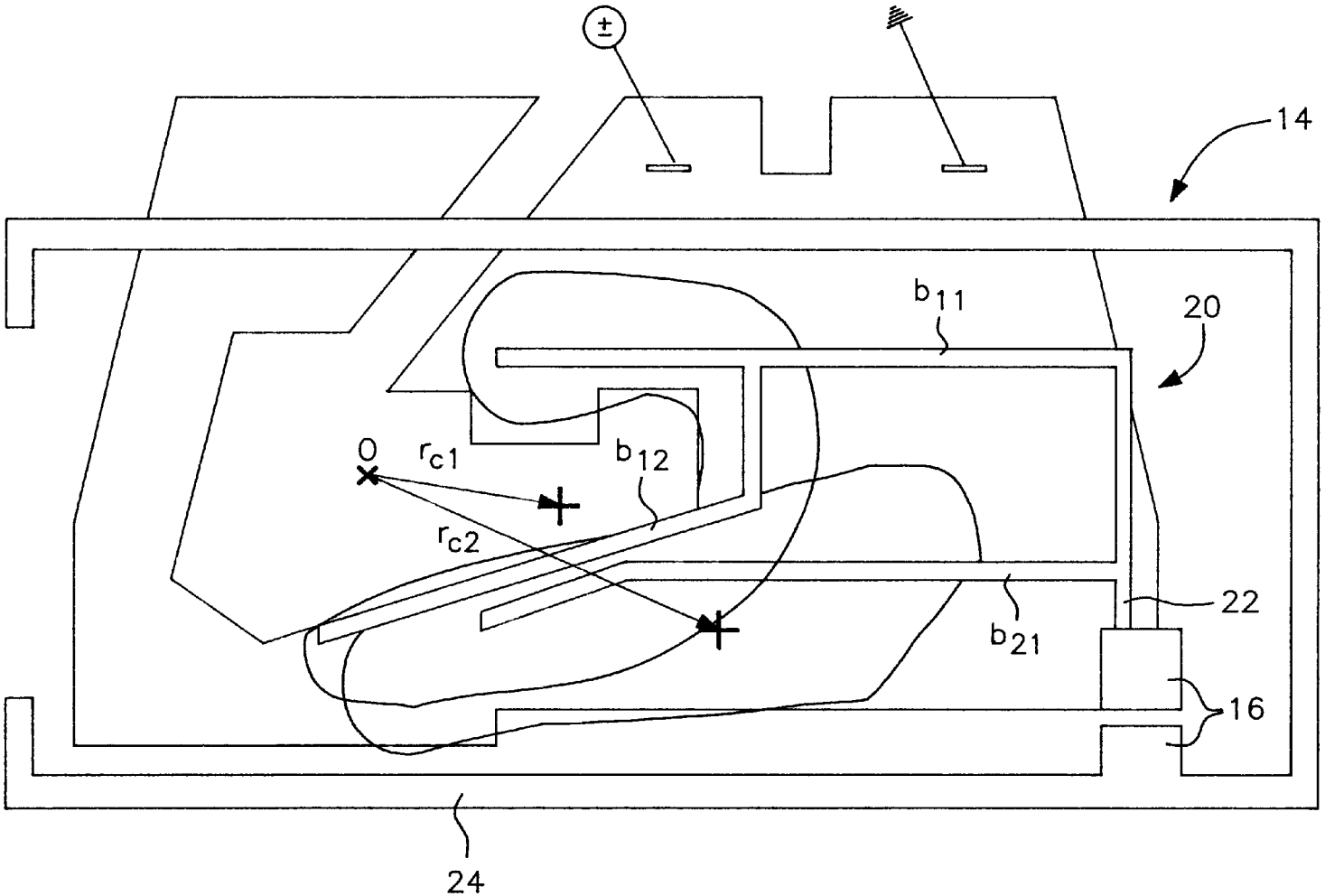
FIGS. 8 and 9 shows a second embodiment of an antenna coupling device according to the present invention, intended to be used with the first antenna according to FIGS. 6 and 7.
Figure 9:
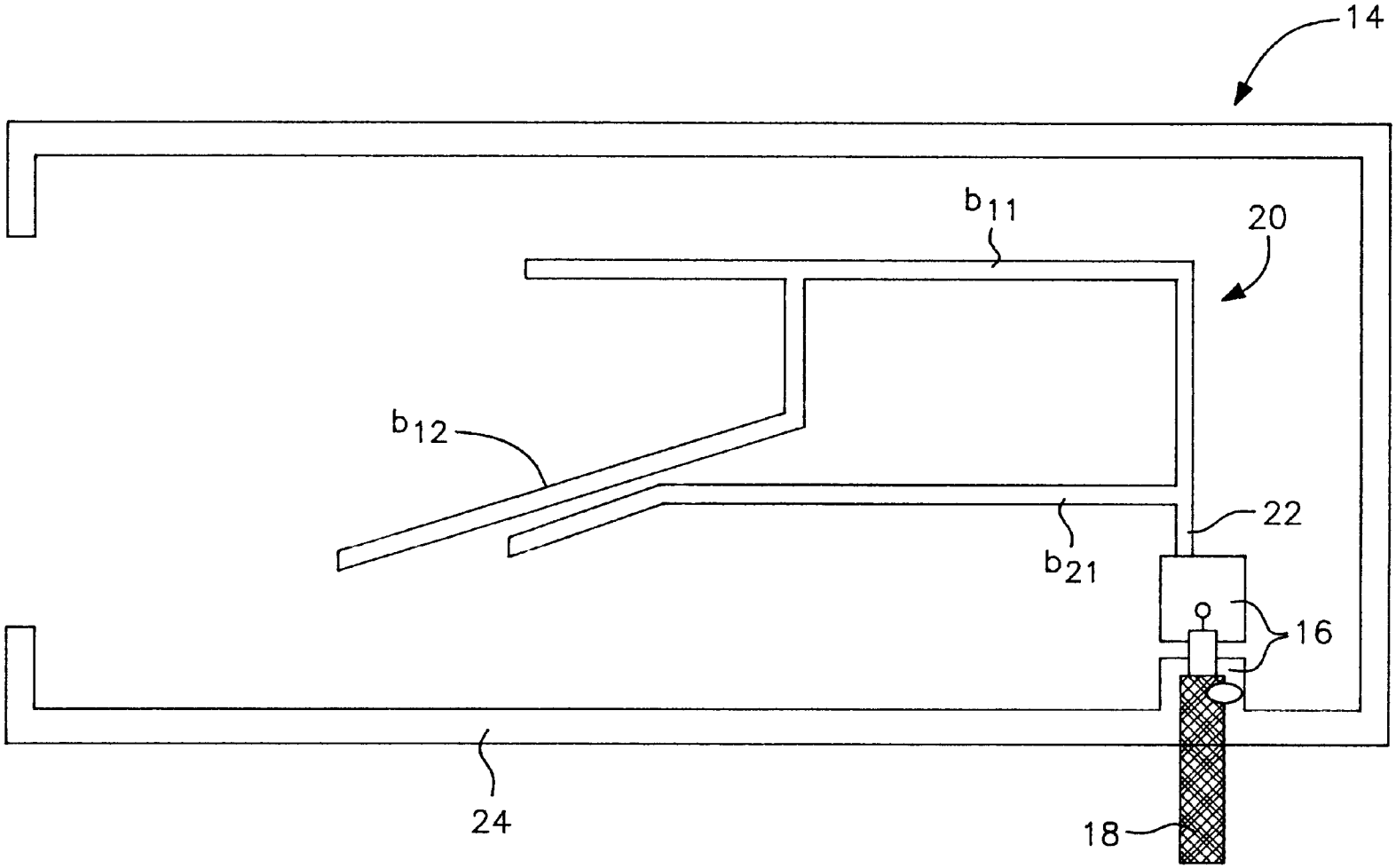

In FIGS. 8 and 9 there is disclosed a second embodiment of an antenna coupling device 14 according to the present invention, intended to be used with the first antenna according to FIGS. 6 and 7. The antenna coupling device 14 comprises a port 16 connected to a coaxial cable 18. The conducting surface of the antenna coupling device 14 has a geometric shape in the form of a tree structure 20 connected to said port 16. The tree structure 20 comprises a stem 22 which starts at said port 16 and tree branches $b_{11}$, $b_{12}$ and $b_{21}$. In this case there are two branches $b_{11}$ and $b_{12}$ for the first frequency band 1 and one branch $b_{21}$ for the second frequency band 2. The reason why there is needed two branches $b_{11}$ and $b_{12}$ for the first frequency band 1 is that the geometrical shape of the domain $D_1$ is so complicated. The branches $b_{11}$ and $b_{12}$ is mainly placed above the domain $D_1$ of the first antenna and is intended to pick up a considerable part of the electromagnetic wave in the frequency band 1. The branch $b_{21}$ is mainly placed above the domain $D_2$. In FIGS. 8 and 9 there is also disclosed an open ground plane 24.

Figure 10:
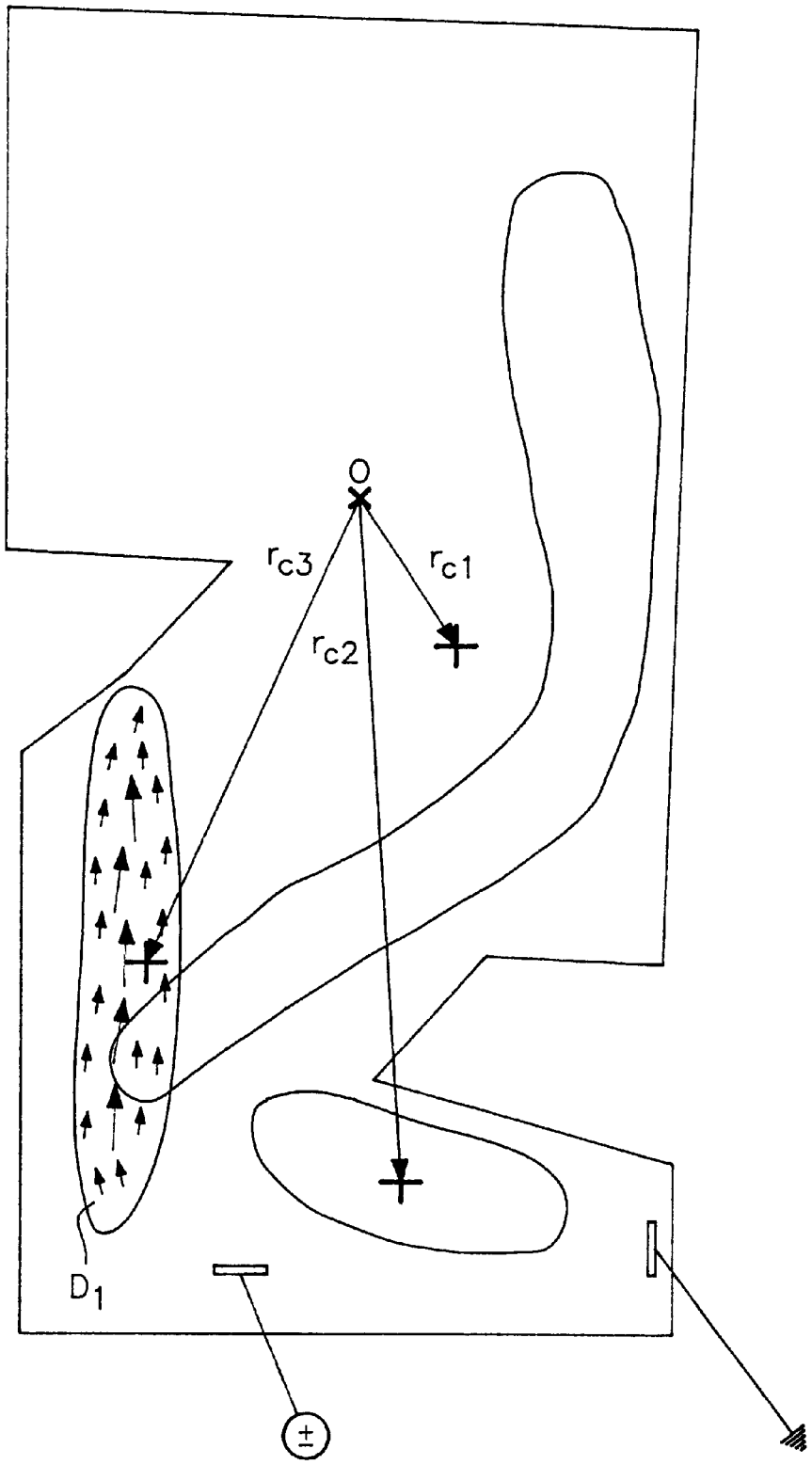
FIGS. 10–12 shows the current density distribution for a third embodiment of an internal first antenna.
Figure 11:
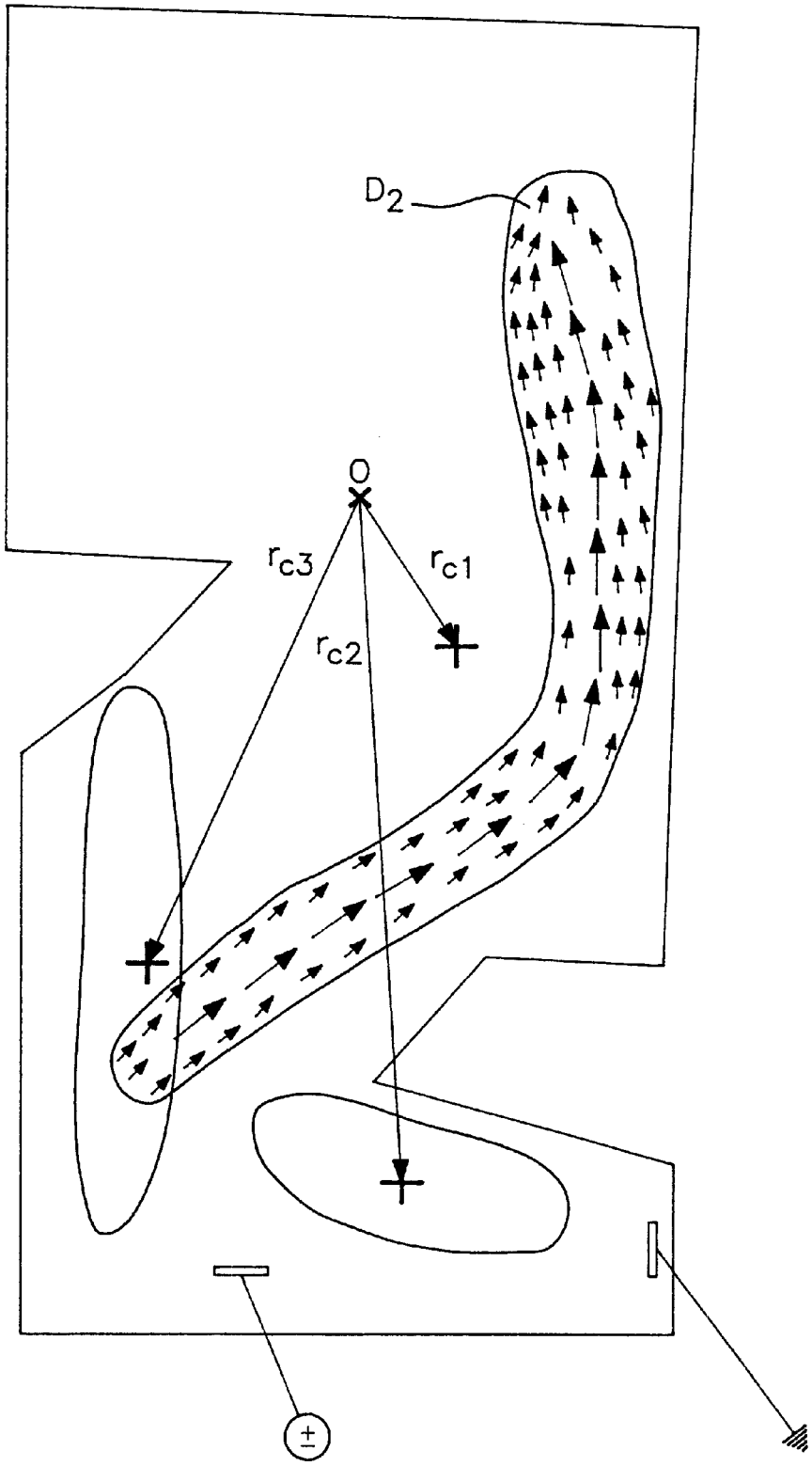
Figure 12:
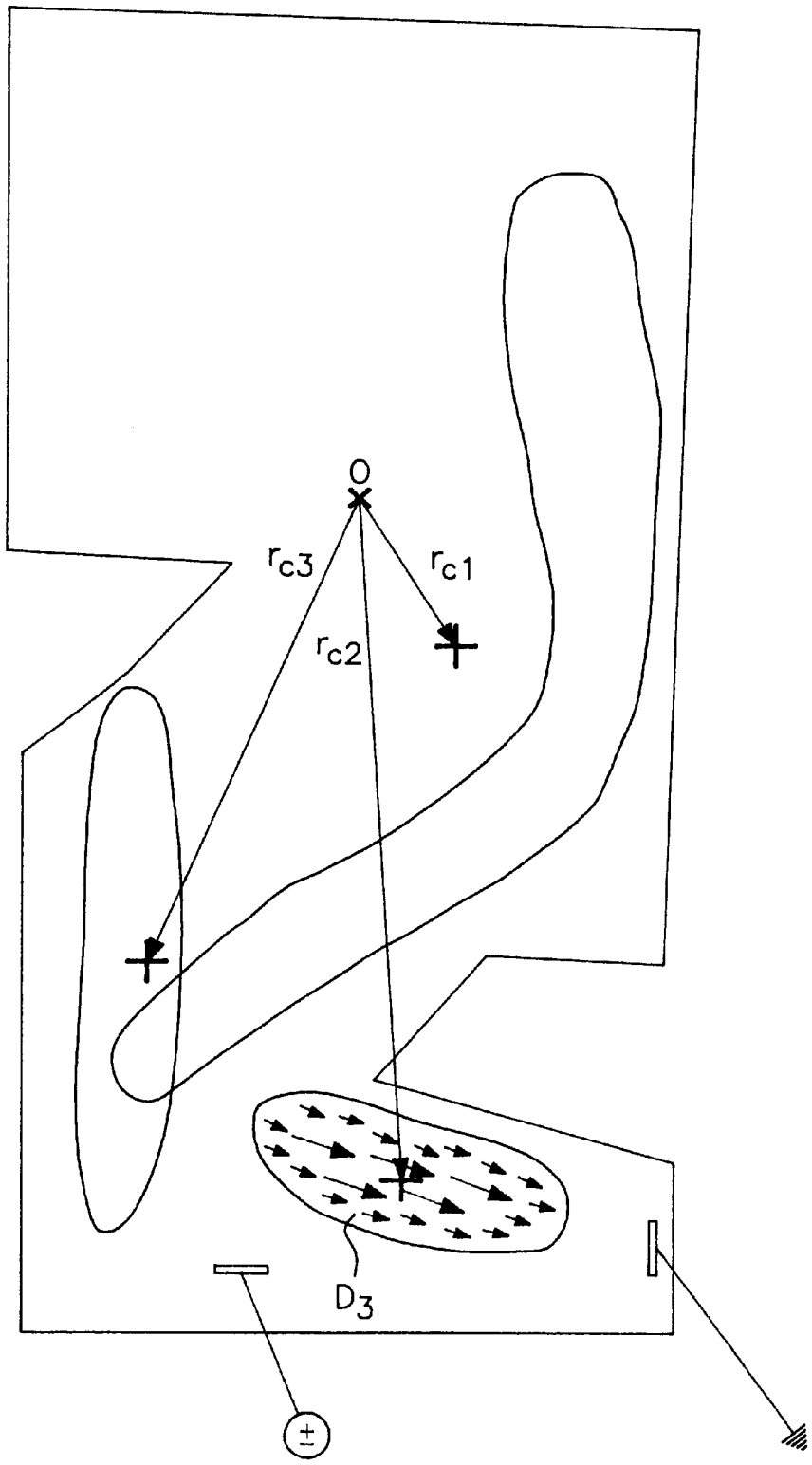

In FIGS. 10–12 there is disclosed the current density distribution for a third embodiment of an internal first antenna, a so called triple band antenna, i.e. an antenna capable to operate in three different frequency bands 1, 2 and 3. In FIG. 10 there is disclosed the current density distribution within the firs domain, $D_1$, for the frequency band 1. In FIG. 11 there is disclosed the current density distribution within the second domain, $D_2$, for the frequency band 2. In FIG. 12 there is disclosed the current density distribution within the third domain, $D_3$, for the frequency band 3.

Figure 13:
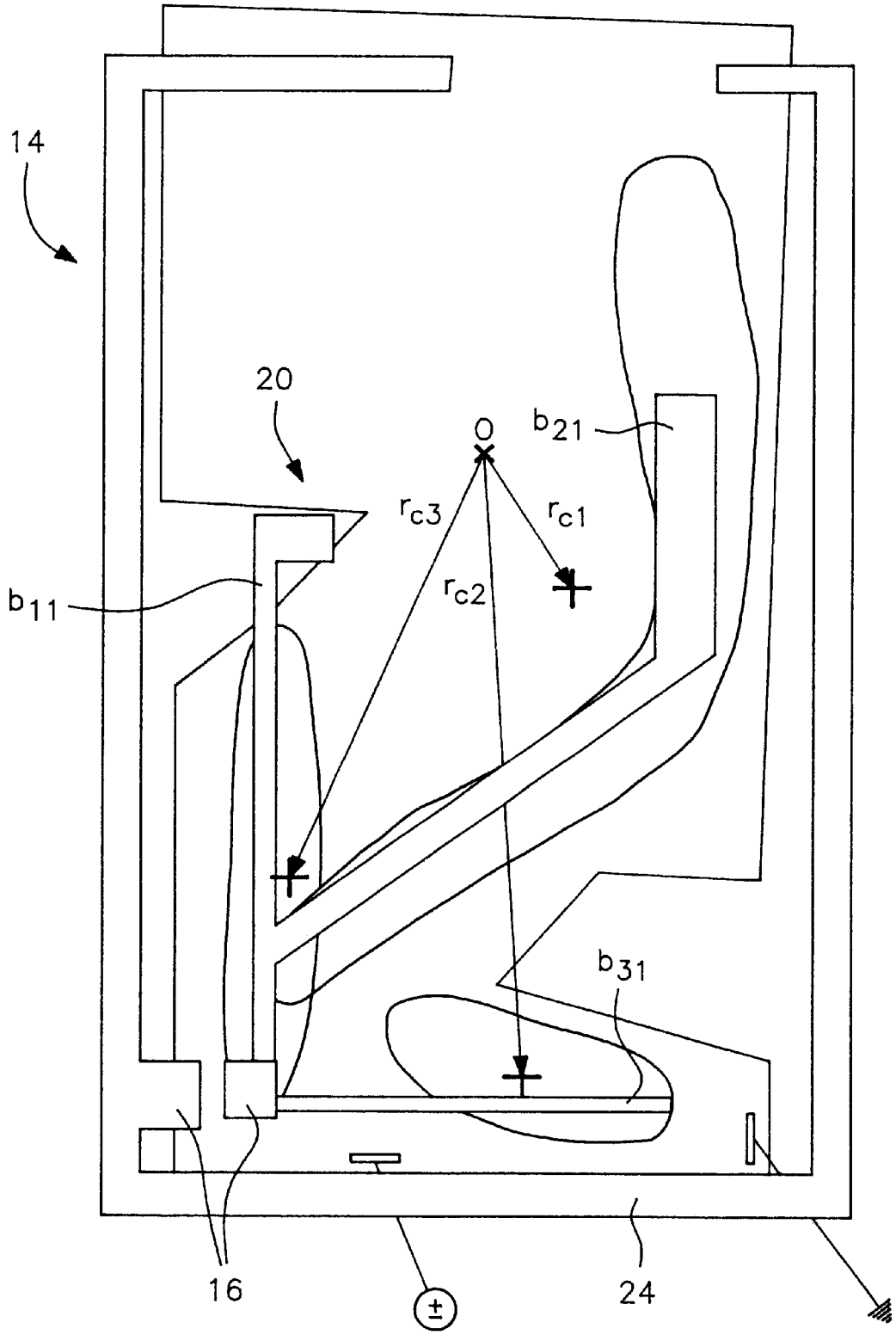
FIGS. 13 and 14 shows a third embodiment of an antenna coupling device according to the present invention, intended to be used with the first antenna according to FIGS. 10–12.
Figure 14:
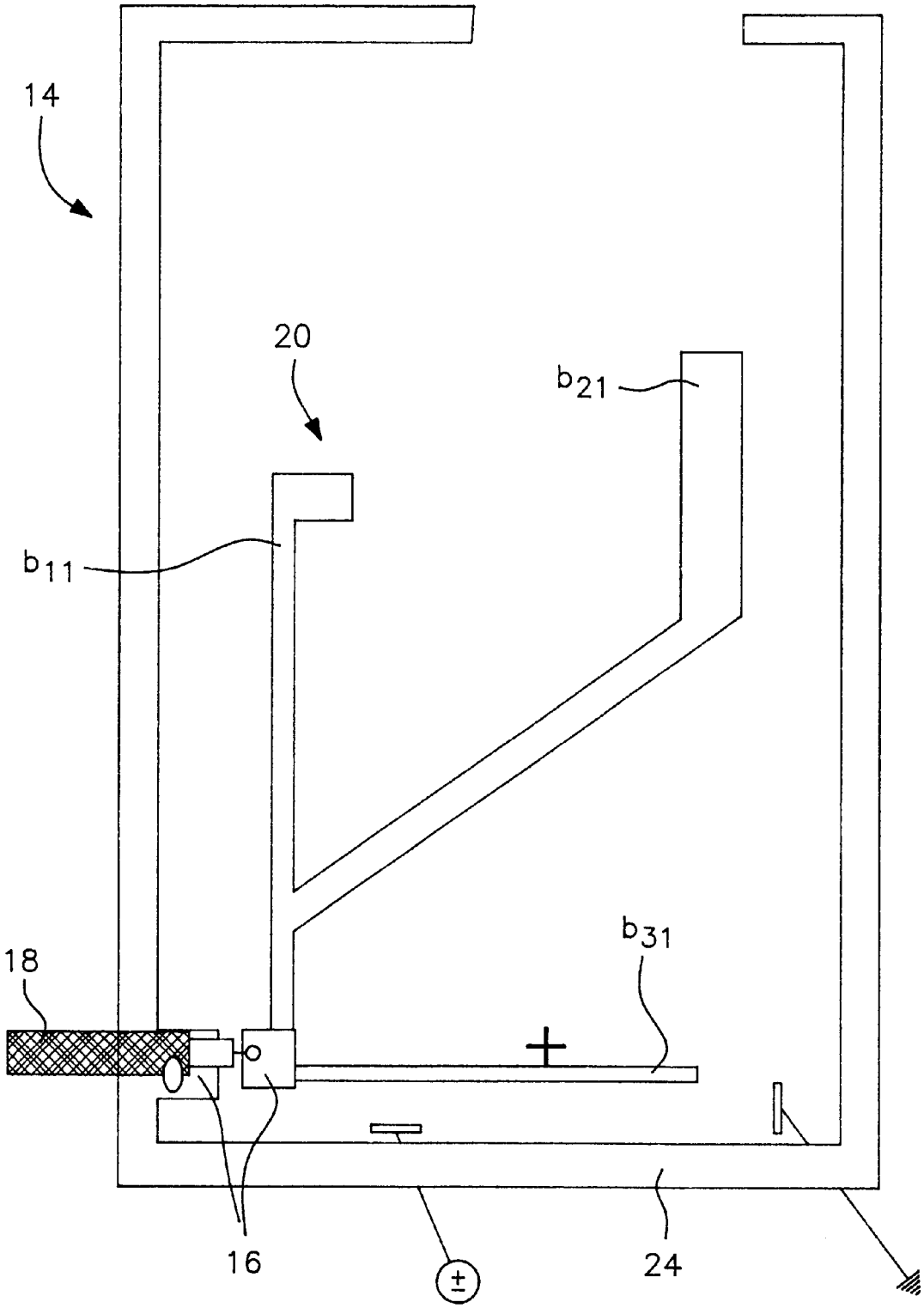

In FIGS. 13 and 14 there is disclosed a third embodiment of an antenna coupling device 14 according to the present invention, intended to be used with the first antenna according to FIGS. 10–12. The antenna coupling device 14 comprises a port 16 connected to a coaxial cable 18. The conducting surface of the antenna coupling device 14 has a geometric shape in the form of a tree structure 20 connected to said port 16. In this case the tree structure 20 does not comprise any stem. Instead, the tree structure 20 comprises three branches $b_{11}$, $b_{21}$ and $b_{31}$. In this case there is one branch for each frequency band. The branch $b_{11}$ is mainly placed above the domain $D_1$, the branch $b_{21}$ is mainly placed above the domain $D_2$, and the branch $b_{31}$ is mainly placed above the domain $D_3$. In FIGS. 13 and 14 there is also disclosed an open ground plane 24.

In FIGS. 15–22 there is disclosed different embodiments of an antenna coupling device 14 according to the present invention.

Figure 15:
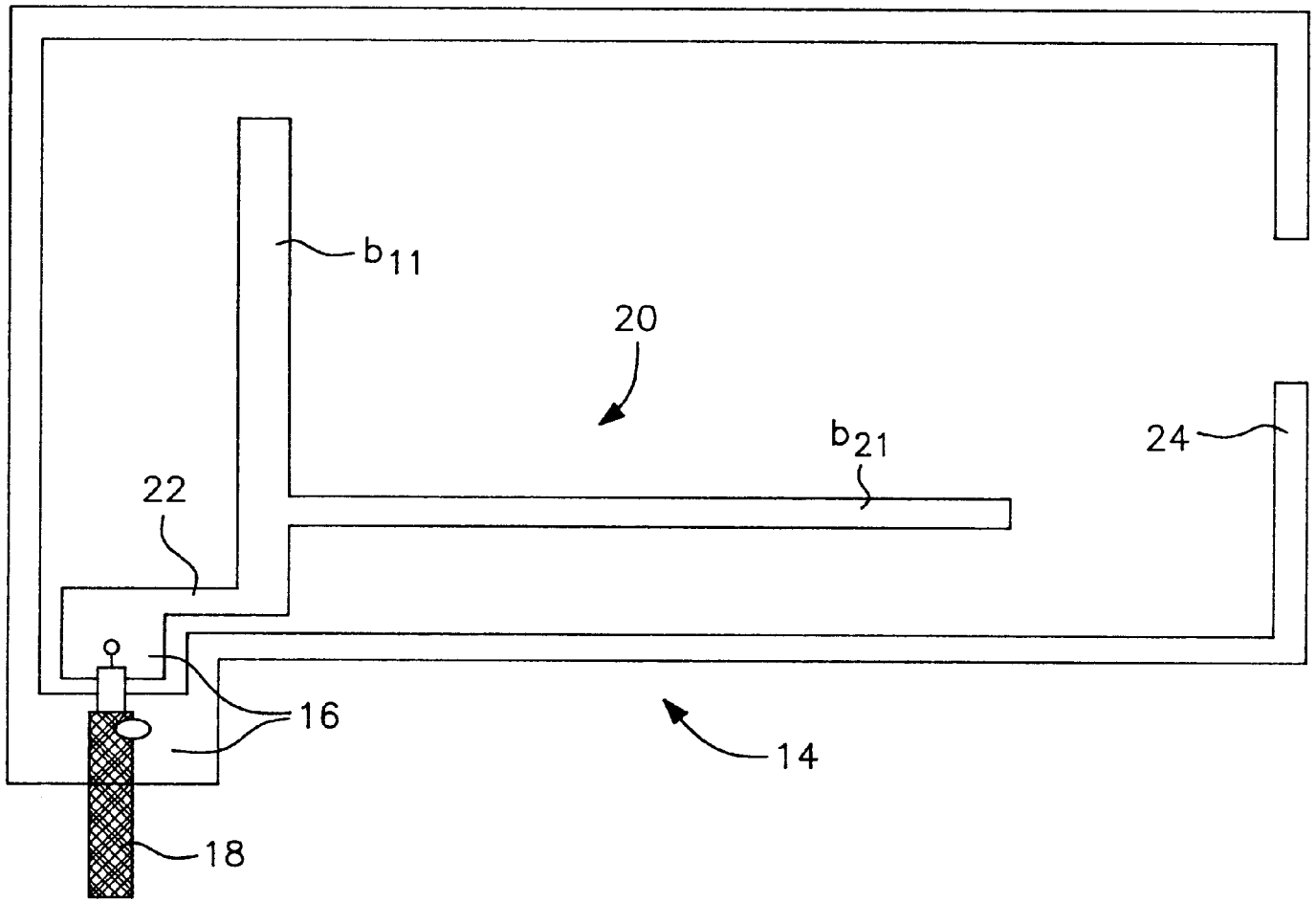
FIGS. 15–22 shows different embodiments of an antenna coupling device according to the present invention.

In FIG. 15 there is disclosed an antenna coupling device 14 comprising a port 16, a stem 22 and two branches $b_{11}$ and $b_{21}$. In this case each branch is straight. As is apparent from FIGS. 9 and 14 this is not always the case. As is apparent from these Figures, a branch can be angled, see e.g. the branch $b_{21}$ in FIG. 14.

Figure 16:
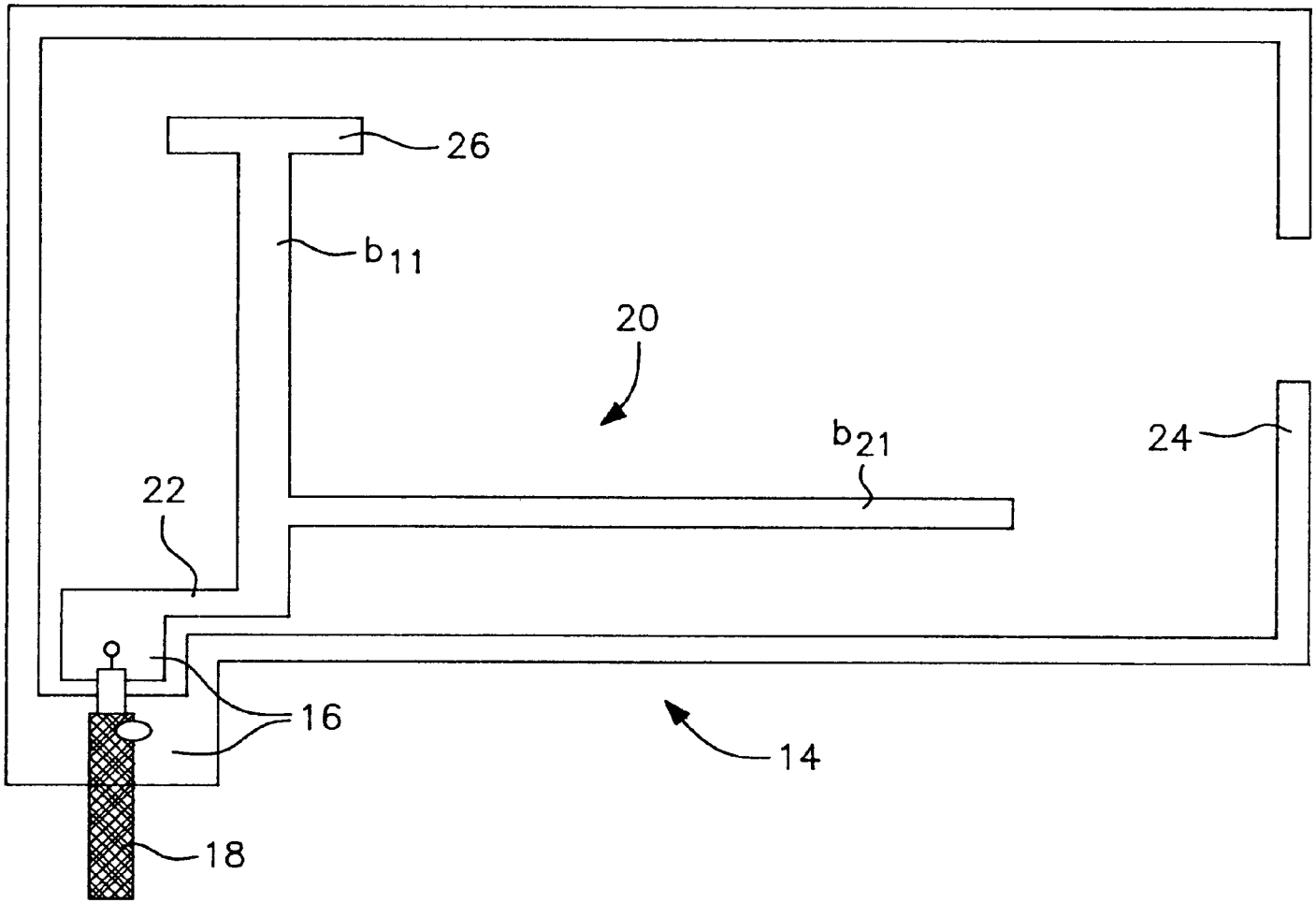

In FIG. 16 there is disclosed a similar antenna coupling device 14 as in FIG. 15, but in this case the branch $b_{11}$ has been complemented with a capacitive loading 26 in order to improve impedance matching. This capacitive loading can be placed at another position, not necessarily at the end of a branch as is disclosed in FIG. 16.

Figure 17:
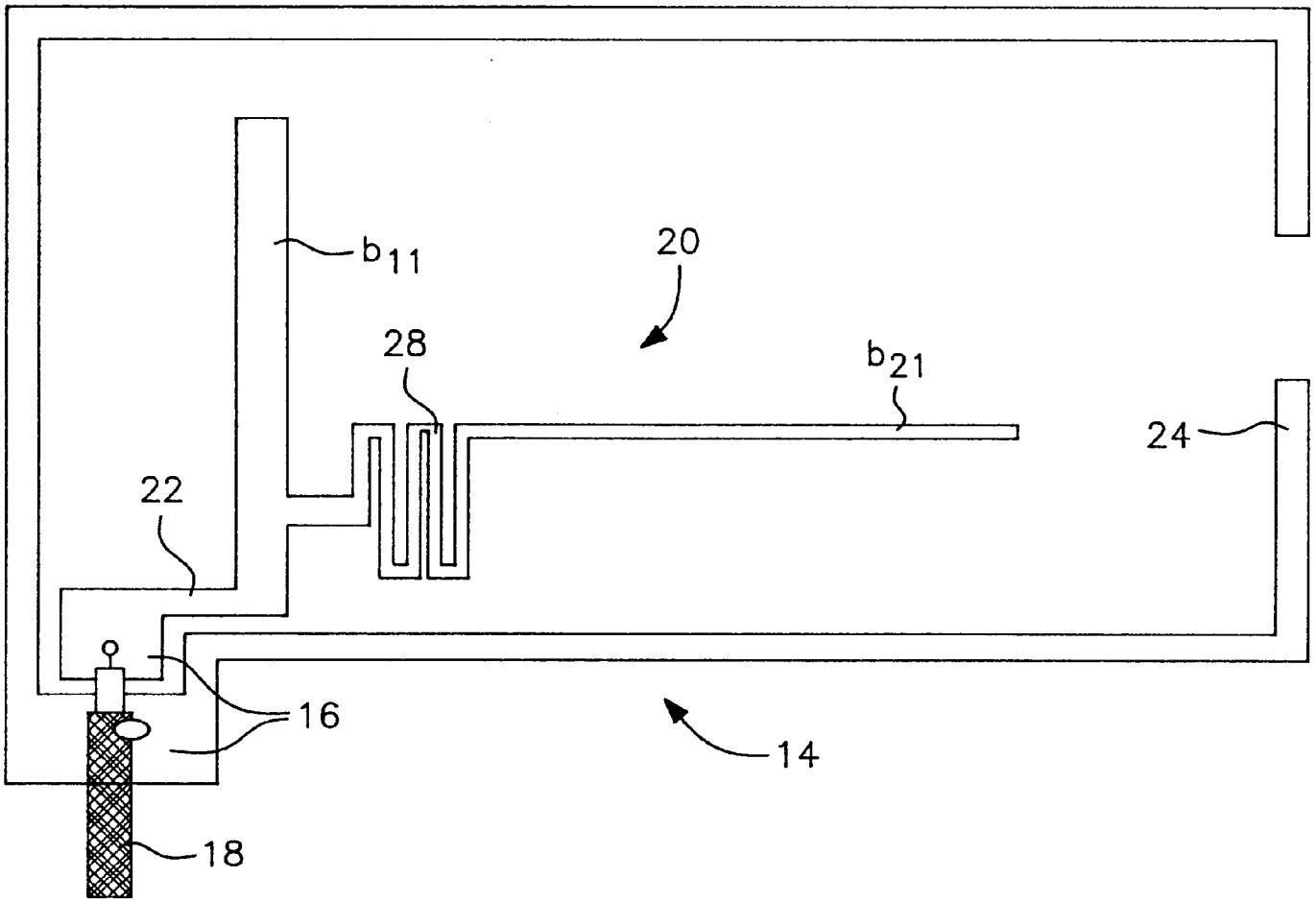

In FIG. 17 there is disclosed a similar antenna coupling device 14 as in FIG. 15, but in this case the branch $b_{11}$ has a part in the form of a meander line 28. This is one way to fulfil the condition that the length of a branch should be at least ⅛th of the wavelength in the medium of the frequency band.

Figure 18:
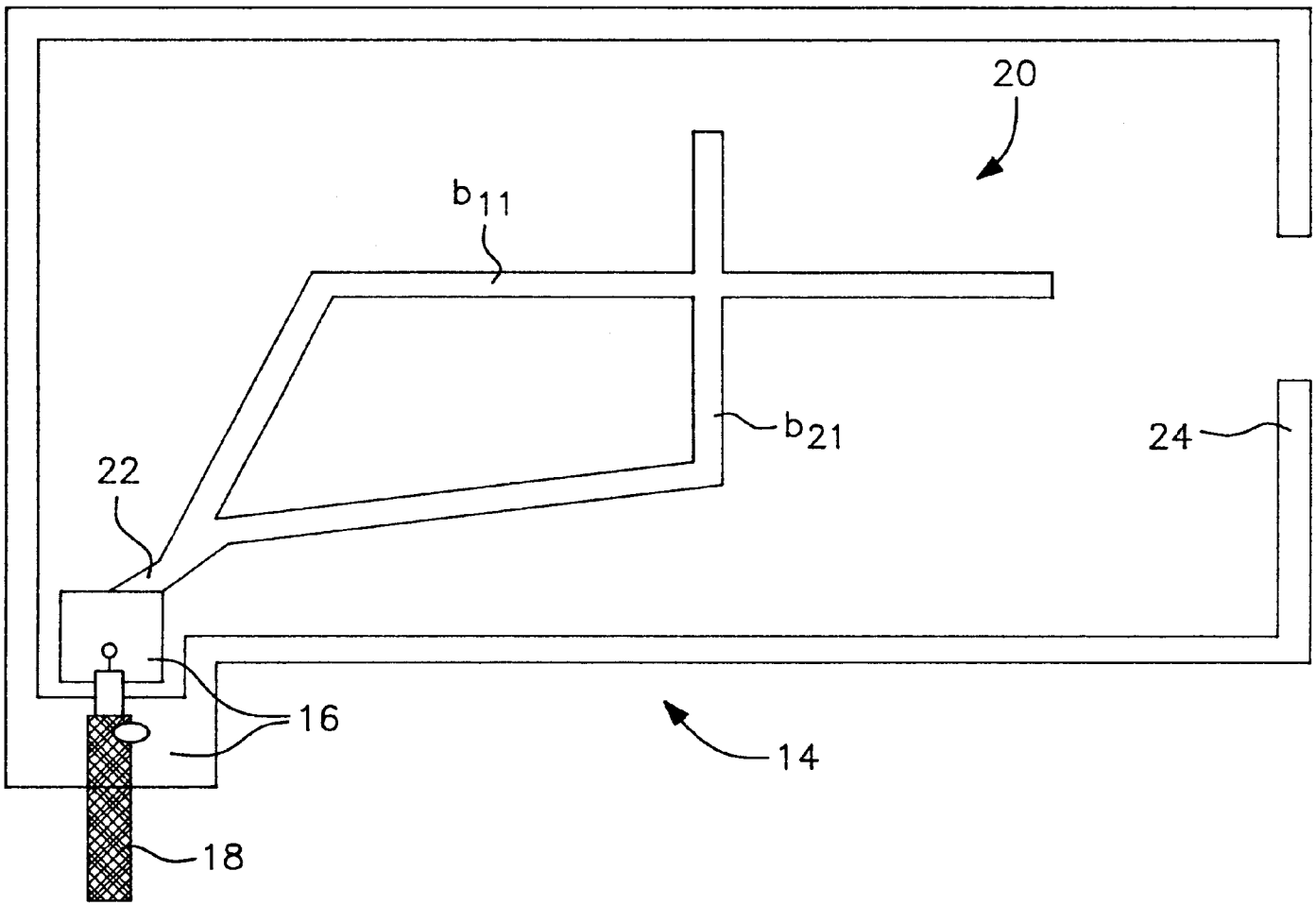

In FIG. 18 there is disclosed an antenna coupling device 14 comprising a port 16, a stem 22 and two branches $b_{11}$ and $b_{21}$. In this case the stem 22 is angled in relation to the port 16 and the two branches $b_{11}$ and $b_{21}$ are intersecting each other.

Figure 19:
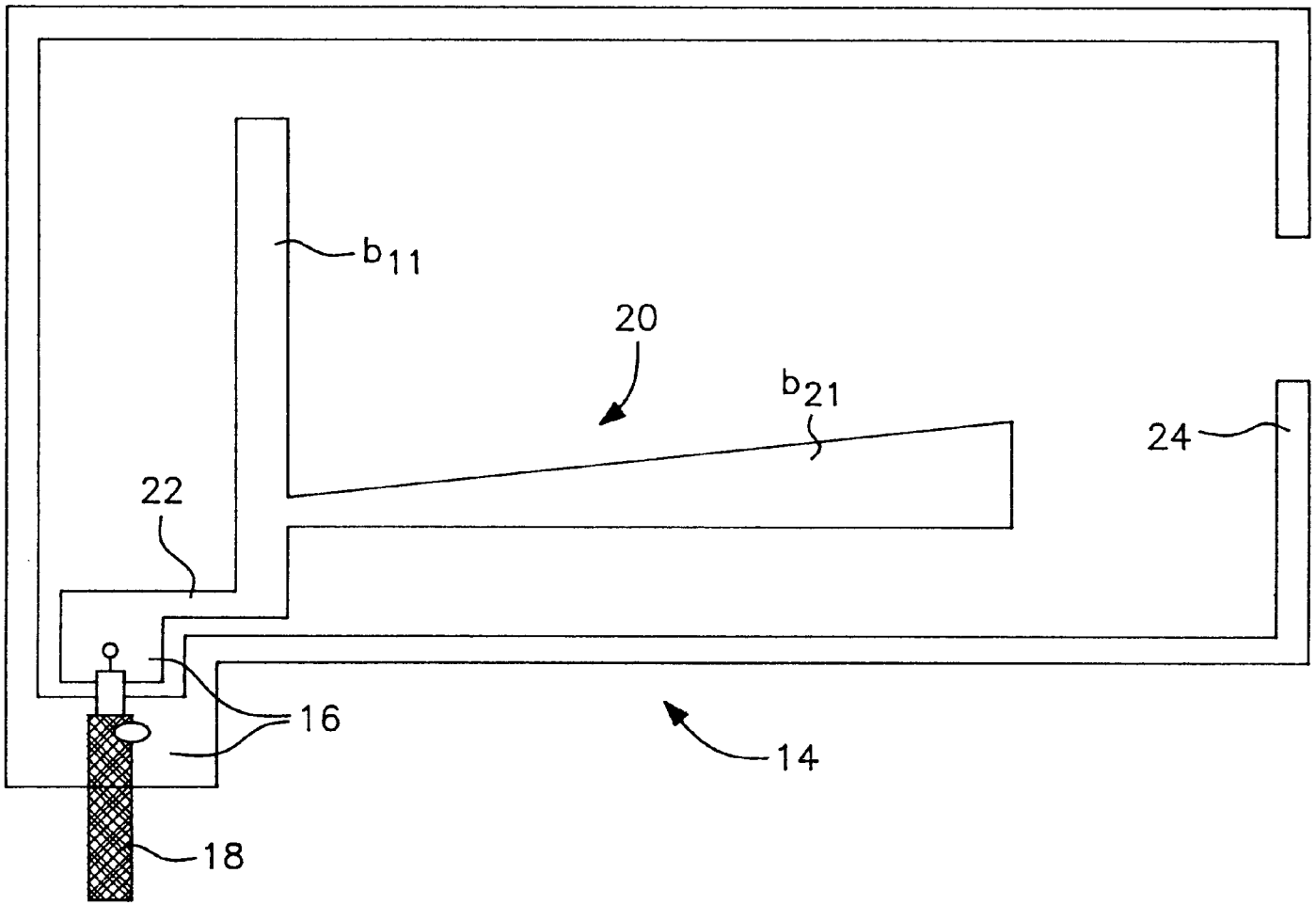

In FIG. 19 there is disclosed an antenna coupling device 14 comprising two branches $b_{11}$ and $b_{21}$, wherein the branch $b_{21}$ has a variable width.

Figure 20:
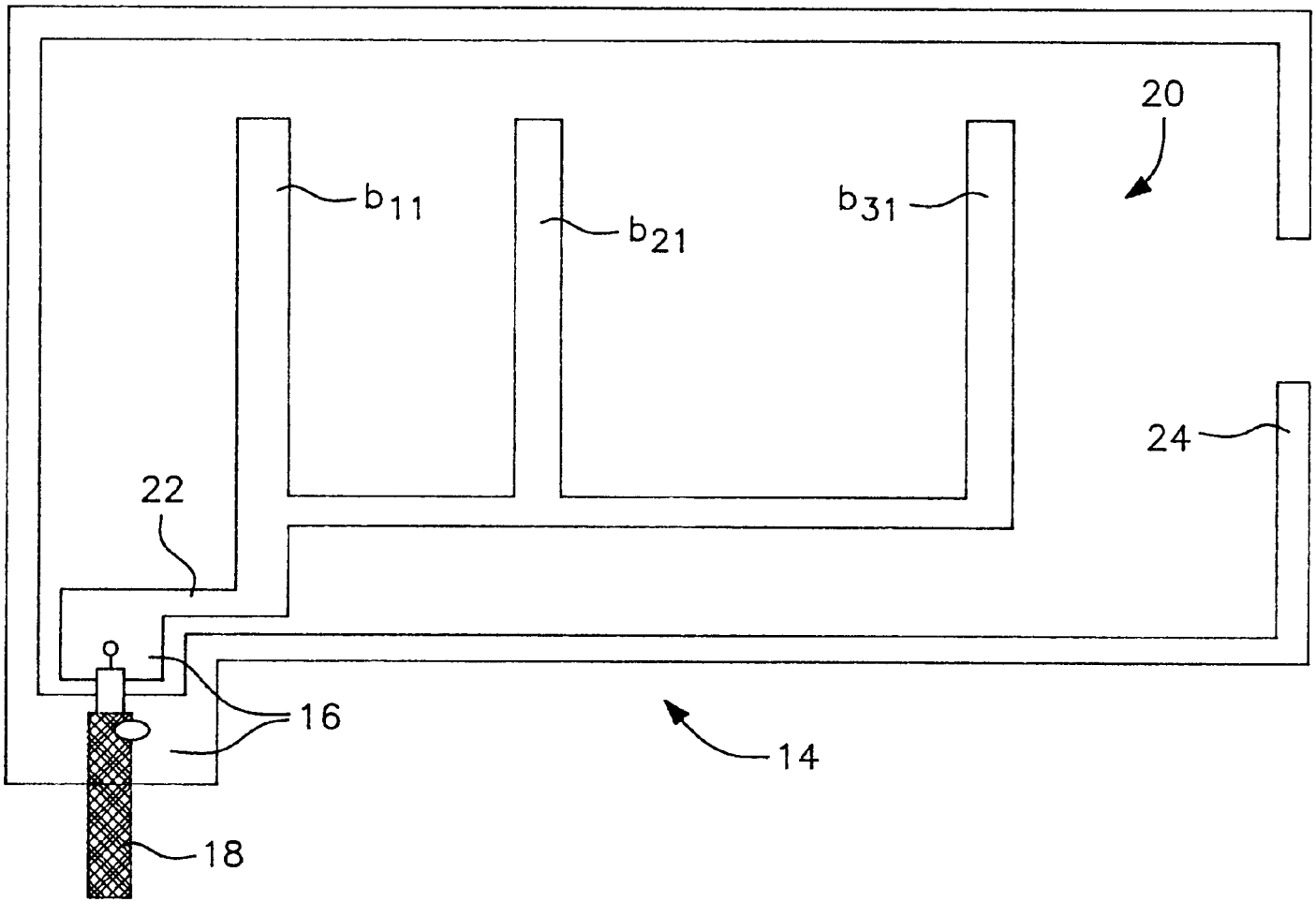

In FIG. 20 there is disclosed an antenna coupling device 14 comprising three branches $b_{11}$, $b_{21}$ and $b_{31}$, for three different frequency bands 1, 2 and 3.

Figure 21:
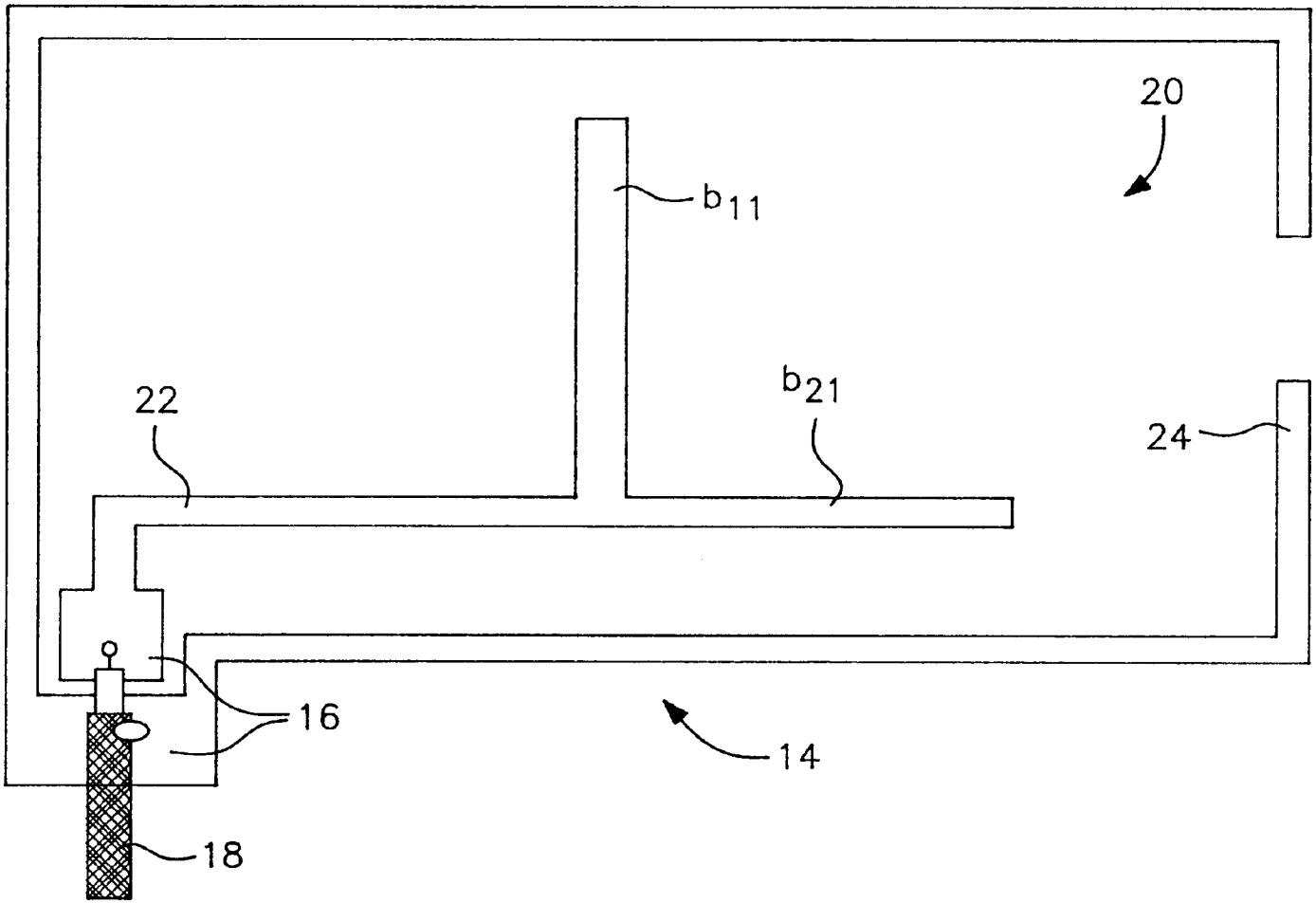

In FIG. 21 there is disclosed an antenna coupling device 14 comprising two branches $b_1$ and $b_{21}$. In this case the stem 22 is very long.

Figure 22:
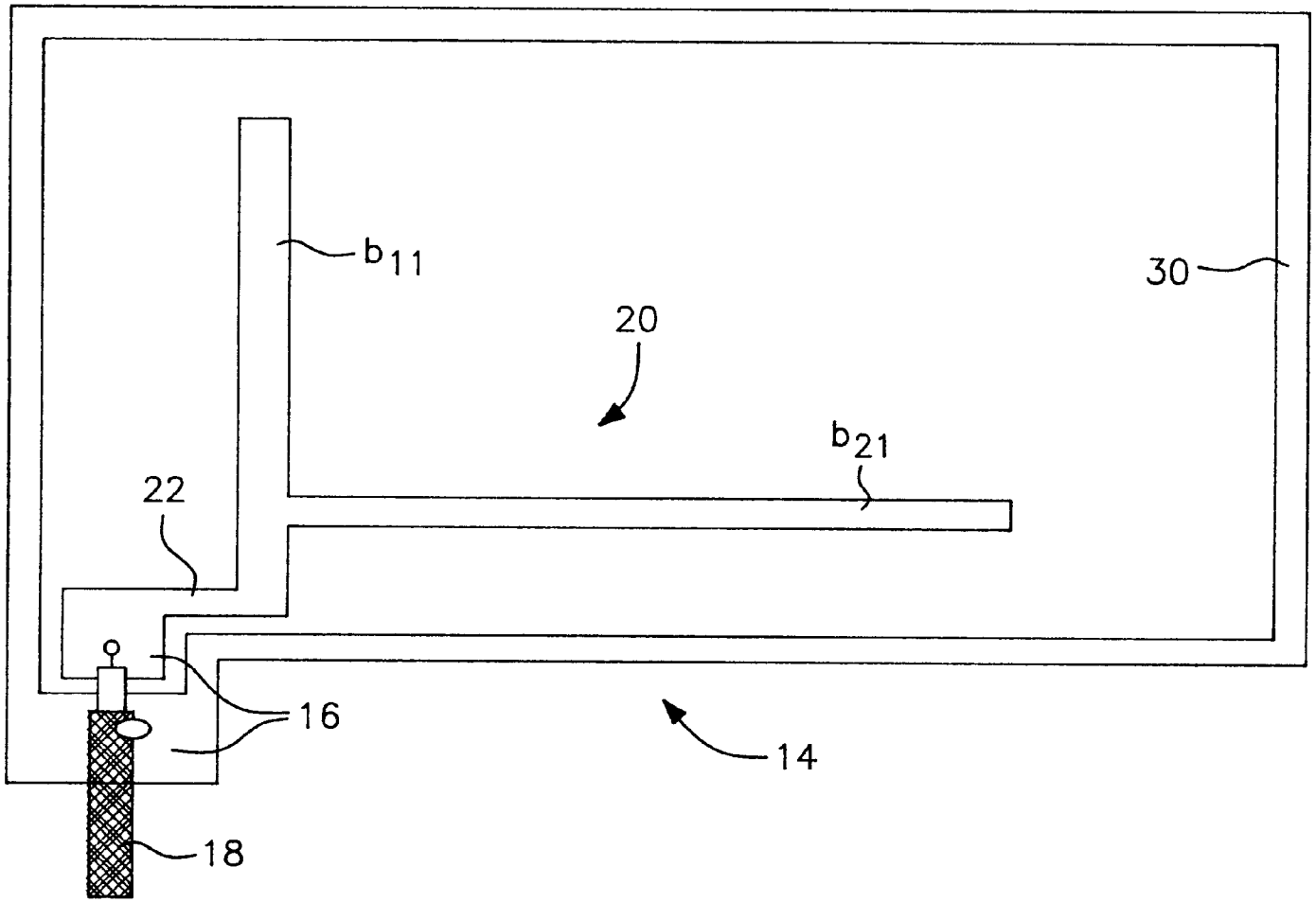

In FIG. 22 there is disclosed an antenna coupling device 14 comprising two branches $b_{11}$ and $b_{21}$. In this case the antenna coupling device 14 comprises a closed ground plane 30.

The invention is not limited to the embodiments described in the fore going. It will be obvious that many different modifications are possible within the scope of the following claims.

What is claimed is:

1. An antenna coupling device (14) for coupling radio frequency signals from a communication device (10) having an internal first antenna, the communication device (10) operable in n frequency bands, where n>1 and n is an integer, wherein said antenna coupling device (14) comprises a port (16) connected/connectable to a transmission line (18), characterized in that a conducting surface of said antenna coupling device (14) has a geometric shape in the form of a tree structure (20) connected to said port (16), wherein said tree structure (20) comprises a number, m, of branches, where $m \geqq n$, wherein said tree structure (20) comprises at least one branch $b_{ix}$ for each frequency band i of said communication device (10), wherein i is an integer and $1 \leqq i \leqq n$, and x is an integer and $1 \leqq x \leqq k(i)$, and the total number, m, of branches satisfy the following expression $$\sum_{i=1}^{n} k(i) = m$$

wherein k(i) is a function of i, which only can obtain an integer value and is the total number of branches for a frequency band i.

2. An antenna coupling device (14) for coupling radio frequency signals from a communication device (10) having an internal first antenna according to claim 1, characterized in that at least one branch $b_{ix}$ for each frequency band i fulfils the condition; a length of said branch $b_{ix}$, as measured form said port (16) to a free end of said branch $b_{ix}$ is not less than about ⅛ of $\lambda_i$, where $\lambda_i$ is the wavelength in the medium at the frequency band i.

3. An antenna coupling device (14) for coupling radio frequency signals from a communication device (10) having an internal first antenna according to claim 1, characterized in that said at least one branch $b_{ix}$ for said frequency band i of said communication device (10) is/are placed, when said antenna coupling device (14) is in operation, above a domain $D_i$ of said internal first antenna, wherein a current causing electromagnetic fields in said at least one branch $b_{ix}$ is intended to pick up a considerable part of an electromagnetic wave in said frequency band i.

4. An antenna coupling device (14) for coupling radio frequency signals from a communication device (10) having an internal first antenna according to claim 3, characterized in that said domains $D_i$ are at least in part disjoint.

5. An antenna coupling device (14) for coupling radio frequency signals from a communication device (10) having an internal first antenna according to claim 1, characterized in that each branch $b_{ix}$ has a constant width.

6. An antenna coupling device (14) for coupling radio frequency signals from a communication device (10) having an internal first antenna according to claim 5, characterized in that the widths of at least two branches $b_{ix}$ are equal.

7. An antenna coupling device (14) for coupling radio frequency signals from a communication device (10) having an internal first antenna according to claim 1, characterized in that at least one of said branches $b_{ix}$ has a variable width along said branch $b_{ix}$ .

8. An antenna coupling device (14) for coupling radio frequency signals from a communication device (10) having an internal first antenna according to claim 1, characterized in that at least one of said branches $b_{ix}$ has a part in the form of a meander line $1 \leqq x \leqq k(i)$, and the total number, m, of branches satisfy the following expression $$\sum_{i=1}^{n} k(i) = m$$

wherein k(i) is a function of i, which only can obtain an integer value (28).

9. An antenna coupling device (14) for coupling radio frequency signals from a communication device (10) having an internal first antenna according to claim 1, characterized in that different branches $b_{ix}$ can intersect each other.

10. An antenna coupling device (14) for coupling radio frequency signals from a communication device (10) having an internal first antenna according to claim 1, characterized in that further branches can be used to improve matching of impedance to a characteristic impedance of said transmission line (18).

11. An antenna coupling device (14) for coupling radio frequency signals from a communication device (10) having an internal first antenna according to claim 1, characterized in that said antenna coupling device has an open ground plane (24).

12. An antenna coupling device (14) for coupling radio frequency signals from a communication device (10) having an internal first antenna according to claim 1, characterized in that said antenna coupling device (14) has a closed ground plane (30).

13. An antenna coupling device (14) for coupling radio frequency signals from a communication device (10) having an internal first antenna according to claim 1, characterized in that said tree structure (20) of said antenna coupling device (14) is placed on a printed circuit board.

14. An antenna coupling device (14) for coupling radio frequency signals from a communication device (10) having an internal first antenna according to claim 1, characterized in that said tree structure of said antenna coupling device (14) is in the form of plating.

15. An antenna coupling device (14) for coupling radio frequency signals from a communication device (10) having an internal first antenna according to claim 1, characterized in that said tree structure (20) of said antenna coupling device (14) is in the form of conducting ink.

* * * * *